US005370186A

United States Patent [19]

Ireland

[11] Patent Number: 5,370,186

[45] Date of Patent: Dec. 6, 1994

[54] APPARATUS AND METHOD OF PERFORATING WELLBORES

[75] Inventor: Kelly D. Ireland, Woodlands, Tex.

[73] Assignee: Baker Hughes Incorporated, Houston, Tex.

[21] Appl. No.: 999,269

[22] Filed: Dec. 18, 1992

[51] Int. Cl.[5] ..... E21B 43/116; E21B 23/00

[52] U.S. Cl. ..... 166/297; 166/55.1; 166/212; 166/377; 175/4.52

[58] Field of Search ..... 166/297, 55.1, 212, 166/385, 377; 175/4.52

[56] References Cited

U.S. PATENT DOCUMENTS

| | | | |
|---|---|---|---|
| 2,679,899 | 6/1954 | Osborn | 175/4.52 X |
| 2,915,011 | 12/1959 | Hamill | 175/4.52 |
| 3,138,206 | 6/1964 | Bruce et al. | 166/55.1 |
| 4,042,019 | 8/1977 | Henning | 166/63 X |
| 4,375,834 | 3/1983 | Trott | 166/297 |
| 4,554,975 | 11/1985 | Vann et al. | 166/297 |
| 4,997,041 | 3/1991 | Petree | 166/377 |
| 5,025,861 | 6/1991 | Huber et al. | 166/297 |
| 5,042,593 | 8/1991 | Pertuit | 175/4.52 |
| 5,133,412 | 7/1992 | Coronado | 166/381 |
| 5,156,213 | 10/1992 | George et al. | 166/297 |

OTHER PUBLICATIONS

Vann Systems Engineered Well Completions report entitled "Tool Development Report on Gun Casing Hanger/Release Assembly", date unknown.

*Primary Examiner*—Hoang C. Dang
*Attorney, Agent, or Firm*—Rosenblatt & Associates

[57] ABSTRACT

An anchoring system for a perforating gun is disclosed which supports the gun from above. The anchor can be run in with conventional tools and is settable in the wellbore by pressurizing the wellbore. Upon increasing pressure in the wellbore, the anchor sets the position of the gun by extending slips into the casing or wellbore. A running tool is disclosed which, upon further increase in pressure, disengages the running tool from the anchor. In the preferred embodiment, a detonating mechanism is lowered into the anchor by a slick line and the slick line is removed. Thereafter, further increase in the wellbore pressure sets off the detonator which shoots the gun. The pressure developed from setting off the detonator is the force that releases the slips from the casing or wellbore allowing the entire assembly to drop to the bottom of the wellbore after the gun is fired. The invention also discloses a method and apparatus for manually releasing the anchor and allowing the gun and anchor assembly to drop to the bottom of the wellbore if, for some reason, the gun and anchor assembly have not earlier dropped during the firing of the gun, or if the gun has misfired. In an alternative embodiment, the gun is held to the anchor so that subsequent to firing it does not drop. In this embodiment, a retrieval tool is used to release the slips allowing retrieval of the anchor and gun assembly.

25 Claims, 12 Drawing Sheets

10
R

66
H
A

32
G
34
22
18
16
28
42
46
92
50
40
38
84
86
12
24
20
14
26
30
48
36
44
52

APPARATUS AND METHOD OF PERFORATING WELLBORES

FIELD OF THE INVENTION

The field of the invention relates to perforating guns and, specifically, anchors for such guns and mechanisms, and methods for placement, release or retrieval of anchors and perforating guns.

BACKGROUND OF THE INVENTION

In general, perforating guns are lowered into wellbores by a number of means, including electric line, or rigid or coiled tubing. The guns are supported from the surface or supported by a device downhole in proximity of the perforating gun. Utilizing surface suspension, perforating guns are run to correct depth via electric line, or rigid or coiled tubing and fired at a desired depth. The fired guns are then pulled to surface or occasionally released and dropped to the bottom of the wellbore. Downhole suspension of the perforating guns is accomplished by a number of means. Utilizing rigid or coiled tubing to run perforating guns enables a hookwall packer to anchor guns in a cased hole or inflatable packer to anchor guns in an open hole. Using electric line enables an electric line activated permanent packer to suspend a perforating gun at a desired depth.

The prior assemblies have several shortcomings. If using electric line to run and position a gun, gun length is limited by the length of the surface lubricator when perforating a wellbore underbalanced. When an electric line set packer is utilized to anchor a gun, a time consuming milling operation is required to release the packer.

If using downhole suspension to anchor the perforating guns, other disadvantages are encountered associated with coiled or rigid tubing. Using rigid tubing requires make up of the string at the surface and necessarily creates significant delays in positioning the gun in the wellbore for perforation. Use of rigid tubing also requires that the reservoir be stabilized prior to removal. This results in higher operational cost and excess reservoir damage which limits reservoir profitability. The use of coiled tubing may be restricted due to cost or available rig space considerations.

Those skilled in the art realize that the downhole perforating gun anchor may be located above, below or anywhere along the length of the perforating gun. When support for the perforating gun is downhole from the gun and problems ensue in the release of the gun, operations are necessarily made more complicated to try and remove the gun. Since support for the gun is downhole, if the gun becomes stuck and requires milling to be removed, the entire length of the gun has to be milled prior to the support system or slips being reached so that the assembly can drop to the bottom of the wellbore.

The apparatus and method of the present invention provide support for the gun uphole from the gun. Therefore, if problems develop in firing the gun, ordinary fishing tools can be used to remove it. If milling is required to remove the gun, substantially less milling is required prior to the release of the slips so that the remaining anchor assembly with the gun below can fall to the bottom of the wellbore.

In order to address the concerns about having to jar with electric line, the apparatus and method of the present invention have been developed to allow hydraulic set of the anchor for the perforating gun when the assembly is run in the hole with an electric line, or rigid or coiled tubing. A running tool for the anchor gun assembly has been designed to release primarily by hydraulic pressure in the wellbore with a secondary backup of mechanical release. Accordingly, the apparatus and method of the present invention can be used to hydraulically set an anchor in situations where the setdown weight may be too low for a setting mechanism relying on relative movement due to weight of the components.

The apparatus and method also provide for a way to release the anchor and drop the gun if for any reason it has failed to automatically release when shot. Means are provided which, in the preferred embodiment, are mechanical to allow overriding of the grip of the slips to release the gun and anchor assembly to the bottom of the wellbore. Alternatively, the anchor can be constructed so that it is not automatically released after the gun is shot. A retrieving tool can then recover the assembly of the gun and anchor from the wellbore.

A positive release of the slips using a pressure balanced piston whose movement sequentially undermine the cones supporting the slips in the engaged position is also provided to assure a smooth release from the casing or wellbore by the slips.

SUMMARY OF THE INVENTION

An anchoring system for a perforating gun is disclosed which supports the gun from above. The anchor can be run in with conventional tools and is settable in the wellbore by pressurizing the wellbore. Upon increasing pressure in the wellbore, the anchor sets the position of the gun by extending slips into the casing or wellbore. A running tool is disclosed which, upon further increase in pressure, disengages the running tool from the anchor. In the preferred embodiment, a detonating mechanism is lowered into the anchor by a slick line and the slick line is removed. Thereafter, further increase in the wellbore pressure sets off the detonator which shoots the gun. The pressure developed from setting off the guns is the force that releases the slips from the casing or wellbore allowing the entire assembly to drop to the bottom of the wellbore after the gun is fired. The invention also discloses a method and apparatus for manually releasing the anchor and allowing the gun and anchor assembly to drop to the bottom of the wellbore if for some reason, the gun and anchor assembly have not earlier dropped during the firing of the gun, or if the gun has misfired. In an alternative embodiment, the gun is held to the anchor so that subsequent to firing it does not drop. In this embodiment, the retrieving tool is used to release the slips allowing retrieval of the anchor and gun assembly.

DETAILED DESCRIPTION OF THE DRAWINGS

FIGS. 1A–1C are a sectional view of the anchor gun assembly during run in;

DETAILED DESCRIPTION OF THE PREFERRED EMBODIMENT

The preferred embodiment of the apparatus and method is illustrated in FIG. 1. The assembly is suspended by a running tool R which is connected to hanger assembly H. A connection G is mounted at the lower end of hanger assembly H and supports the perforating gun (not shown) which is to be used in the procedure. The perforating gun is not illustrated because any one of several styles or types of perforating guns can be used without departing from the spirit of the invention. Those skilled in the art will know the running, releasing and retrieval tools may be a single wire line tool or a combination of any number of wire line tools to accomplish the required function.

Figures 10A, 10B:
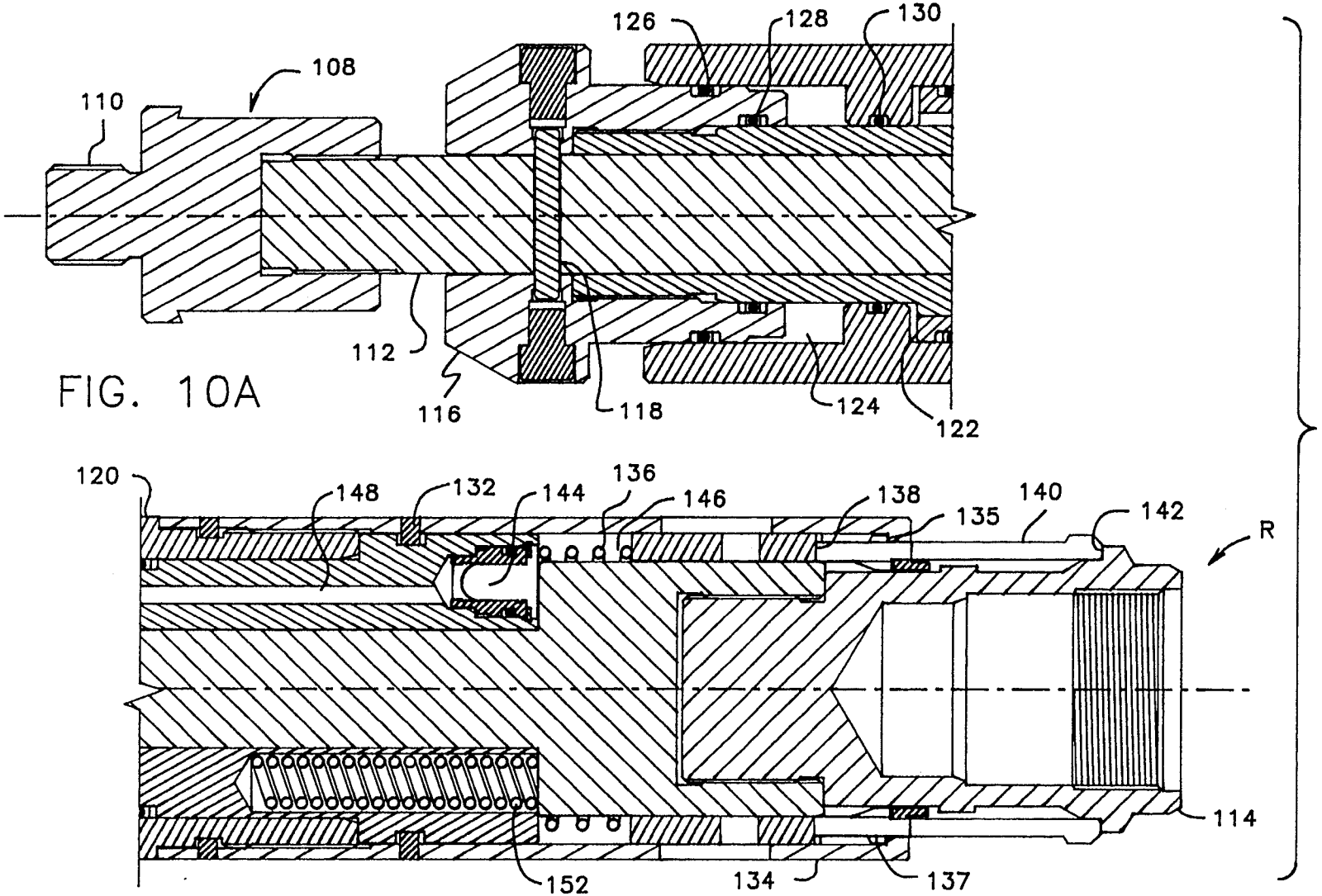
FIGS. 10A–10B are an alternative embodiment of a running tool which actuated by hydraulic pressure.
Figures 11A, 11B:
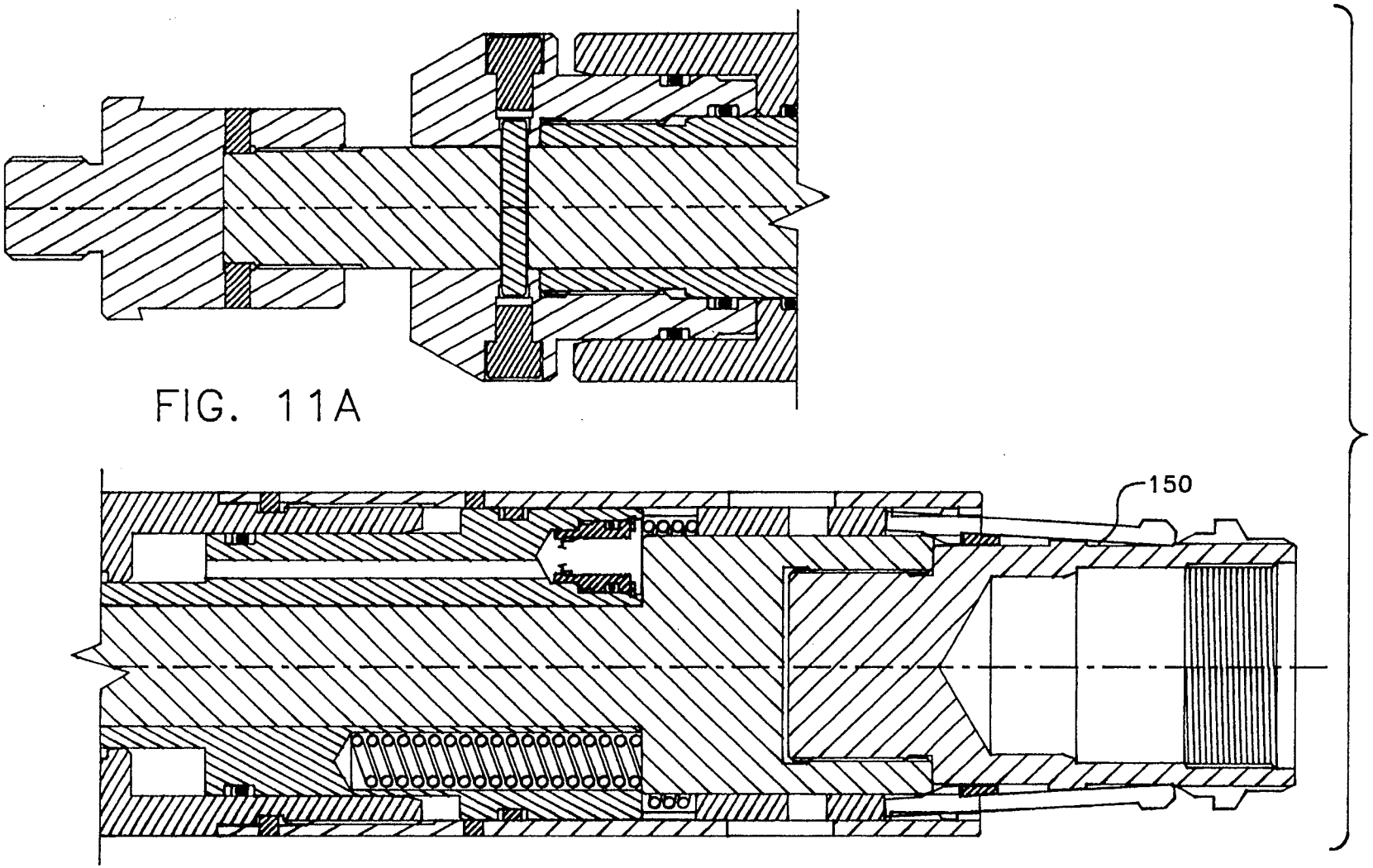
FIGS. 11A–11B are the running tool of FIGS. 10A–10B in a disengaged position.
Figure 12:
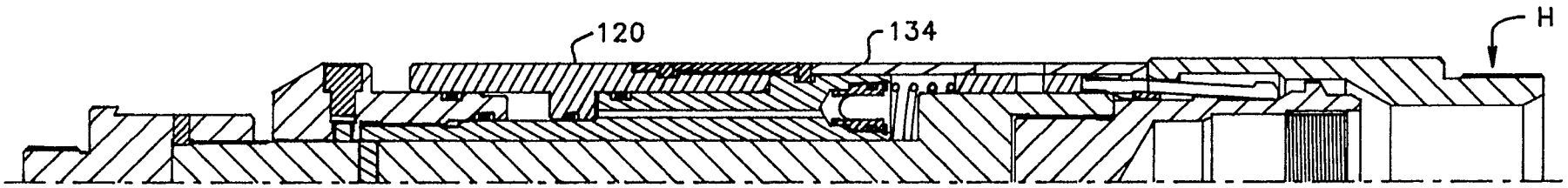
FIG. 12 is the running tool of FIGS. 10A–10B in the jar down released position.

The hanger assembly is adapted to use several types of known running tools known in the industry as Baker Models GS or GH. In a Model GS running tool, the release is accomplished by a jar down. In a Model GH running tool run with coil tubing, the release is accomplished by dropping a ball and pressurizing on the coil tubing for a primary release with a secondary setdown shear release. A new running tool has also been developed as illustrated in FIGS. 10, 11, and 12, which is engageable to inner shoulder 10 as shown in FIG. 1. Those skilled in the art will know that the location of the contact for support between the positioning tool and the hanger assembly H can be varied without departing from the spirit of the invention.

Figures 1A, 1B, 1C:
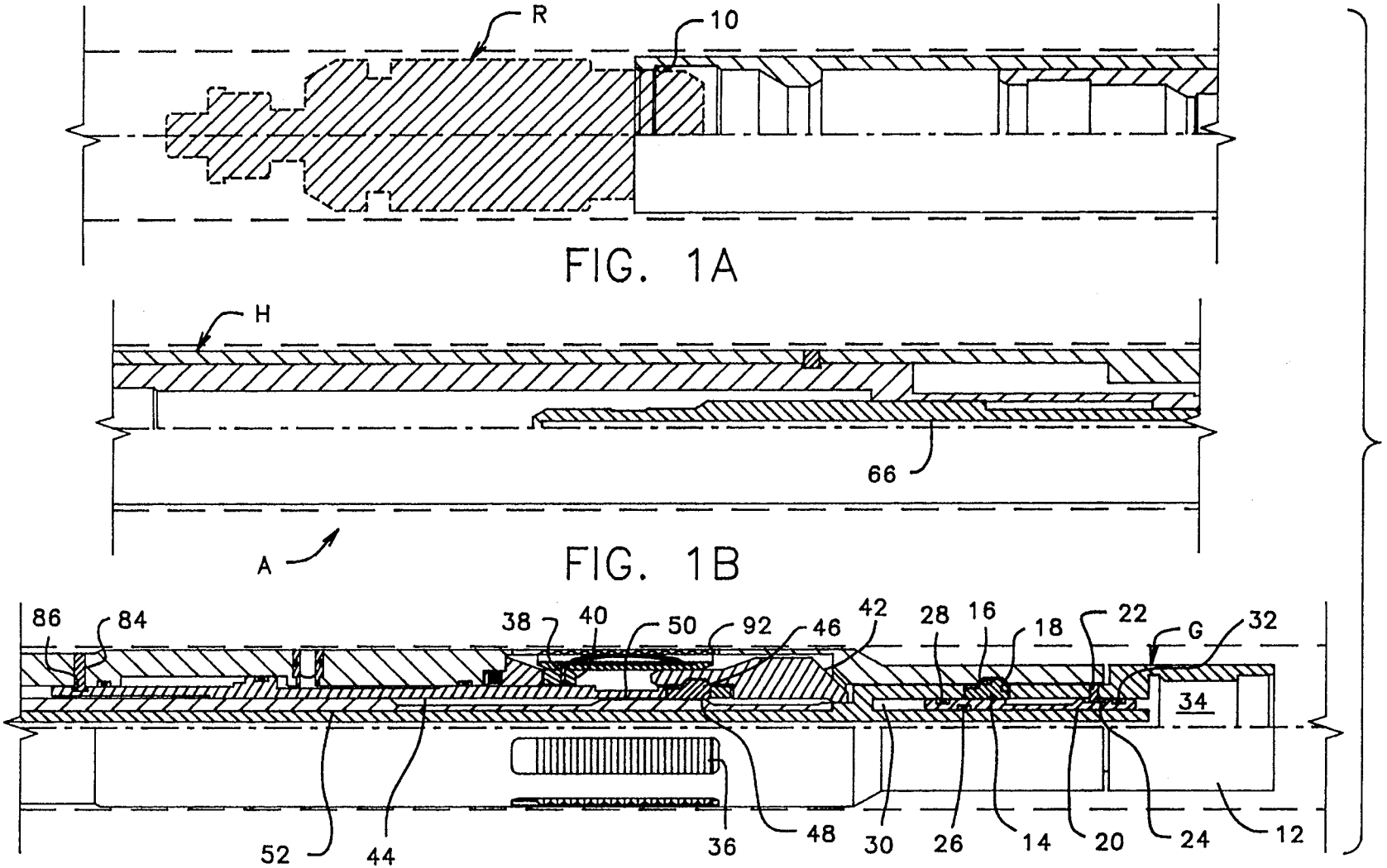

The run in position is illustrated in FIG. 1. The running tool R is connected to inner shoulder 10 to support the hanger assembly H. Hanger assembly H supports the connection G which ultimately holds the perforating gun (not shown). FIG. 1C illustrates how the hanger assembly H supports the connection G. A mandrel 12 is mounted directly to the gun and is supported to the hanger assembly H via a system which includes a plurality of keys 14. Keys 14 in the running position of FIG. 1C extend into depressions 16 through an opening 18 in the body of mandrel 12. During the run in position, the keys 14 are supported by piston 20. Piston 20 is connected to mandrel 12 by shear pin 22, which extends into depression 24 of piston 20. Seals 26 and 28 seal off cavity 30. Cavity 30 is at atmospheric pressure when the apparatus A is lowered into the wellbore. Seals 32 and 26 seal between the piston 20 and the mandrel 12. Cavity 34 becomes pressurized during the firing sequence and exerts a pressure on piston 20. Seals 32 and 26 allow the pressure built up in cavity 34 to drive piston 20, as will be described below when the operational sequence of the apparatus A is discussed.

Figures 7A, 7B, 7C:
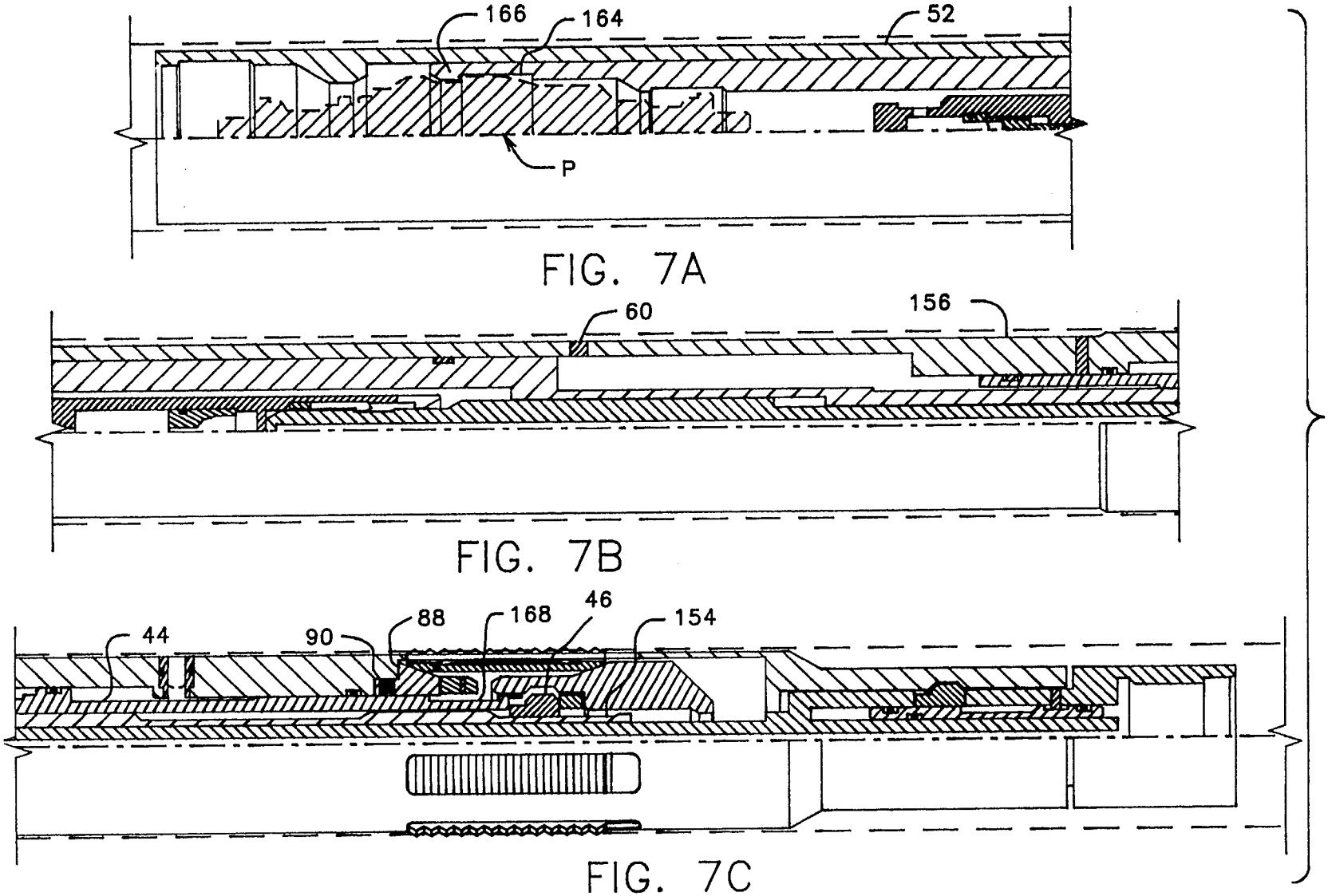
FIGS. 7A–7C are the gun anchor assembly of FIGS. 1A–1C with a releasing tool inserted to release the slips.
Figures 8A, 8B, 8C:
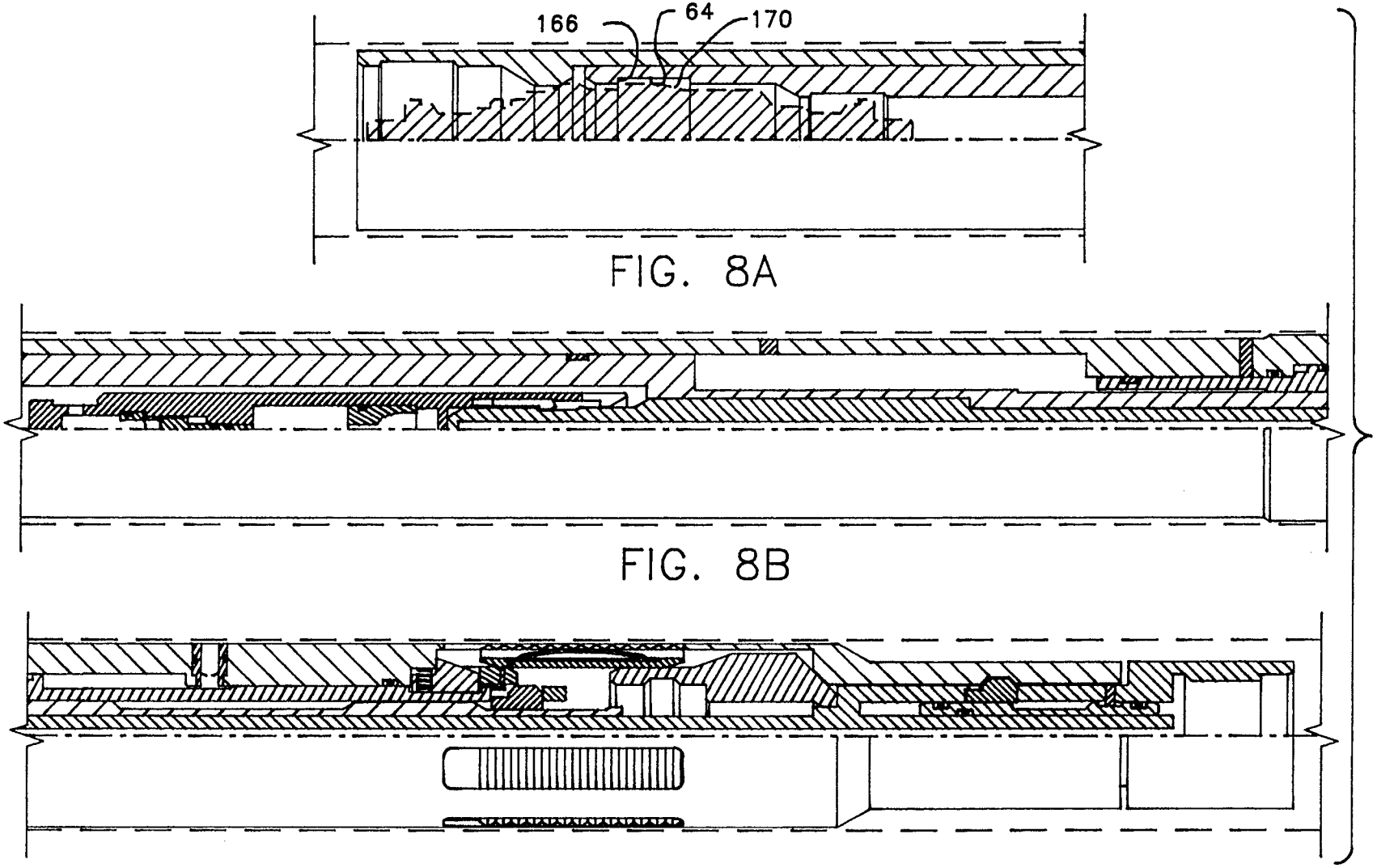
FIGS. 8A–8C are the view of FIGS. 7A–7C showing the completion of movement to release the slips with a releasing tool and illustrating the auto-release of the releasing tool to allow the gun anchor assembly to fall.

The anchoring mechanism of hanger assembly H comprises a plurality of slips 36. The slips are retained in their run in position as shown in FIG. 1C through the use of shear pin 38 which extends from housing 62 into the slips 36. During the run in position shown in FIG. 1C lower cone 42 is keyed to piston 44 by virtue of keys 46 extending through opening 48 in piston 44. Keys 46, during the run in position, are supported by surface 50 of outer sleeve 52. Outer sleeve 52 has depressed surfaces 54 and 56 (see FIG. 2C), as well as a shoulder 58. A shear pin 60 connects outer sleeve 52 to housing 62. At the upper end of outer sleeve 52 is internal groove 64 (see FIG. 8A) which can be used for engaging a positioning tool P, as shown in FIG. 7A.

Inner sleeve 66 is an extension of mandrel 12 and is concentrically mounted with outer sleeve 52. Inner sleeve 66 has a shoulder 68 which lies opposed to shoulder 58 for a purpose that will be described below.

Housing 62 accommodates a rupture disc 70 which initially blocks passage 72. Passage 72 leads into chamber 74 which is sealed by seals 76 and 78. Seal 76 is mounted to piston 44 and seal 78 is mounted to housing 62. Cavity 80 exists between housing 62 and piston 44 and is sealed off by seals 76 and 82. Seal 82 is mounted to housing 62. During the run in position, the pressure in cavity 80 is atmospheric. A shear pin 84 extends through housing 62 into groove 86 of piston 44. Other means to selectively expose wellbore pressure to piston 44 are within the scope of the invention. Other means to convert applied wellbore pressure to create relative movement is within the scope of the invention.

Inserted in openings in the housing 62 are upper cone segments 88 which are biased inwardly by spring 90. Piston 44 initially supports the upper cone segments 88. The housing 62 has a plurality of openings 92 through which the slips 36 ultimately extend. Slips 36 have a serrated surface 94 for engagement with the casing or wellbore.

Figures 3A, 3B, 3C:
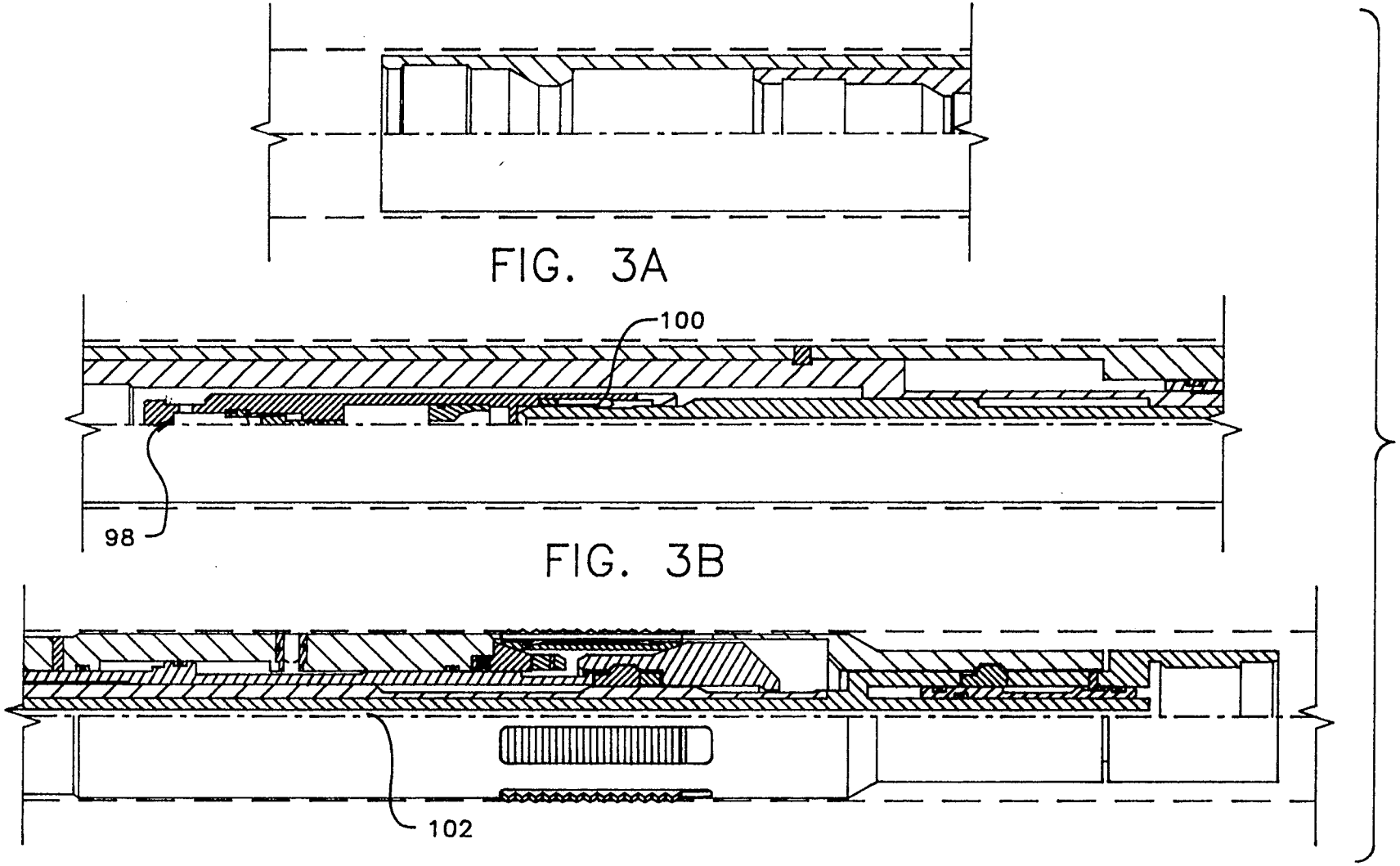
FIGS. 3A–3C show the anchor gun assembly after the insertion of the detonator.

Inner sleeve 66 contains a grooved surface 96. A wire line conveyed detonator 98 (see FIGS. 3A and 3B) can be placed as shown and latched to groove 96 through a plurality of latches 100. Those skilled in the art will appreciate that the detonator 98 can be placed in the location shown in FIGS. 3A and 3B by a slick line or electric line. Once placed in the position shown in FIGS. 3A and 3B, the detonator 98, through cord 102, can initiate the firing of the gun by known means. The detonator assembly is known in the art, and a Model D wire line conveyed detonator produced by Baker Hughes can be used in the preferred embodiment.

Figures 2A, 2B, 2C:
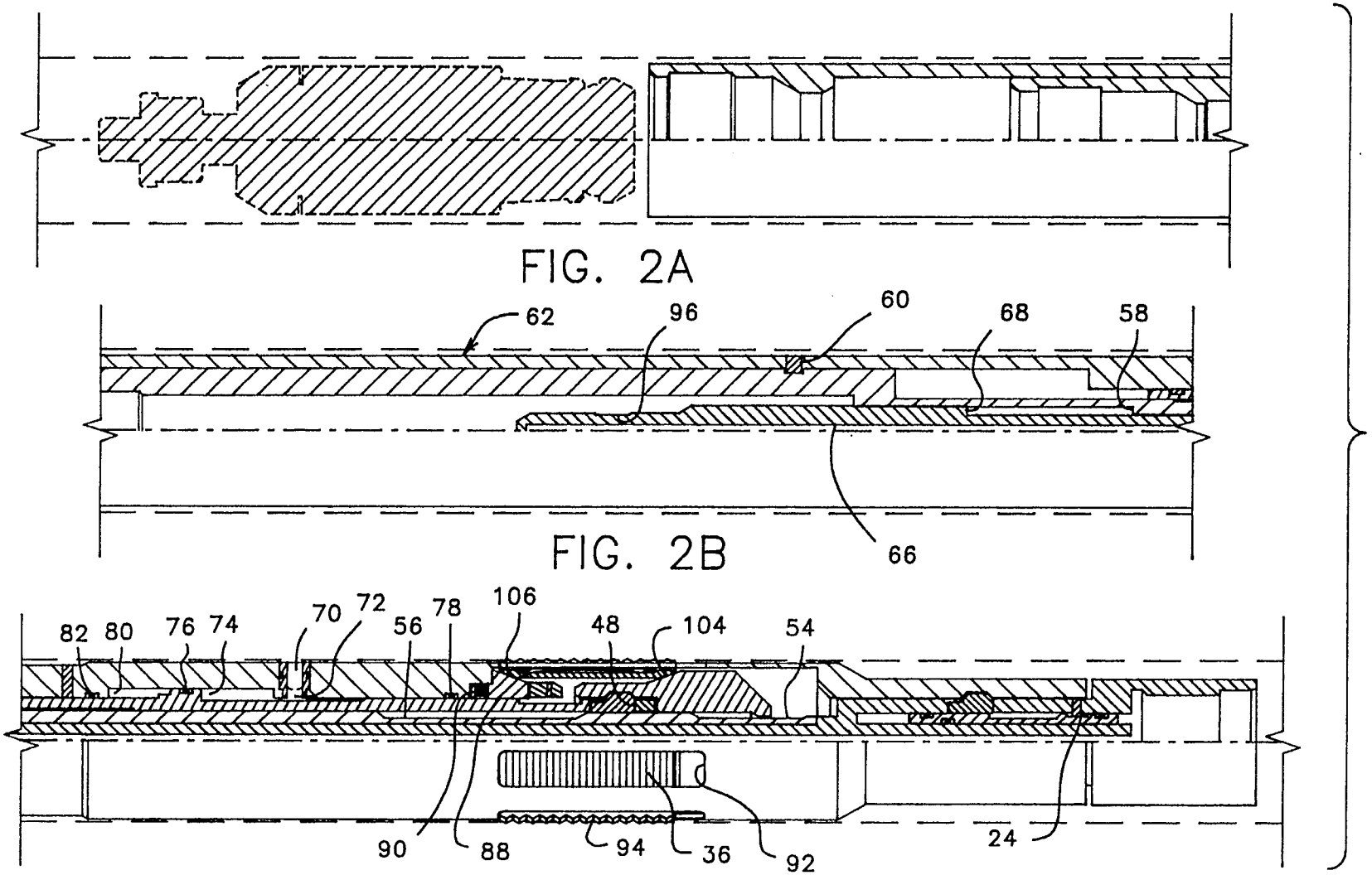
FIGS. 2A–2C are the view shown in FIGS. 1A–1C during the setting of the slips and release of the running tool.

The essential components now having been described the operation of the hanger assembly H to position the gun and the firing and auto-release sequence will now be described. FIG. 1 shows the run in position with the running tool R supporting the hanger assembly H which through a connection G supports the perforating gun. Once the hanger assembly H has been lowered to the appropriate depth, the pressure in the wellbore is raised from the surface until rupture disc 70 ruptures. Since the pressure in chamber 80 is less than the pressure in chamber 74, an unbalanced force acts on piston 44 which drives piston 44 uphole. Movement uphole of piston 44 shears pin 84. Uphole movement of piston 44 brings up lower cone 42 since lower cone 42 is keyed together to piston 44 through keys 14. Keys 14 continue to be supported by outer sleeve 52 thereby retaining the connection between piston 44 and lower cone 42 as it moves up as shown in FIG. 2C. Lower cone 42 has a tapered surface 104 which ramps the slips 36 outwardly as lower cone 42 moves uphole. The upward movement of lower cone 42 pushes slips 36 against ramp surfaces 106 of upper cone segments 88. As a result, ramp surfaces 104 and 106 move closer together pushing each of the slips 36 outwardly into contact with the casing or wellbore.

At this point, the slips 36 are set and the gun is supported. The running tool R can be released by a jar down if it is one such as Baker Model GS. Alternatively, the running tool R can be released by dropping a ball and pressurizing on coil tubing for primary release with a secondary setdown shear release if a Baker Model GH running tool is used. Yet, a third type of running tool may be used which is shown in FIGS. 10, 11, and 12.

The running tool of the present invention (see FIG. 10) has a fishing neck 108 to which a wire line or electric line or slick line can be mounted at connection 110. The fishing neck 108 is connected to a core 112 which is in turn connected to dog support 114. Core 112 extends through shear collar 116. Shear pin 118 retains core 112 to shear collar 116 during the running and pulling position illustrated in FIG. 10. A release piston 120 is mounted over shear collar 116, as well as rupture disc sleeve 122. Chamber 124 is isolated by seals 126 and 128 mounted to shear collar 116, as well as seal 130 mounted to the release piston 120. When the running tool R of FIG. 10 is inserted into the wellbore with hanger assembly H, connection G, and the perforating gun, the pressure in cavity 124 continues to remain at atmospheric pressure. Release piston 120 is restrained from initial movement via shear screw 132. Shear screw or screws 132 extend through cylinder 134 into rupture disc sleeve 122. Dog spring 136 biases dog retainer 138 against dogs 140. By virtue of the force exerted by spring 136, dogs 140 stay in the position shown in FIG. 10 with dogs 140 abutting radial surface 142 on dog support 114. Rupture disc 144 initially isolates the pressure in the wellbore seen in cavity 146 out of passage 148.

The running tool R shown in FIG. 10 can be pressure actuated to release in conjunction with the setting of the slips 36. In the preferred embodiment, the assembly is placed in the wellbore and the wellbore is pressurized. Rupture disc 70 is actuated first to set the slips 36. Thereafter, continued pressurization on the wellbore results in rupturing of rupture disc 144. This allows the pressure in the wellbore to extend through passage 148 and onto release piston 120. Since the pressure in chamber 124 is still atmospheric, and the pressure in passage 148 is the wellbore passage, a pressure imbalance exists on release piston 120 which causes it to shift as illustrated in FIG. 11. Uphole movement of release piston 120 shears shear screws 132 and creates relative movement between dog support 114 and dogs 140 to allow the dogs to retract into depressed surface 150 to facilitate disengagement between the running tool and the inner shoulder 10 (see FIG. 1A) of the hanger assembly More specifically, this occurs because piston 120 is fixed to cylinder 134 which has an internal shoulder 135 which catches abutment 137 making collets 140 move in tandem with piston 120.

If for any reason the hydraulic actuation just described fails to operate, a mechanical override is provided. In that situation, a downward jarring force from a jar (not shown) exerts a downward force on fishing neck 108 which results in shearing a pin 118 with core 112 transmitting the jarring force to dog support 114. FIG. 12 shows the sequence. Cylinder 134 bottoms on housing H. Dog support 114 can still move further down. An upward force is transmitted from housing H (which at this time is fixed) through cylinder 134 to piston 120 through the incompressible fluid in chamber 124 to shear collar 116. Release spring 152 exerts an upward force on rupture disc sleeve 122 which in turn through cylinder 134 keeps the dogs 140 from relatching in the position shown in FIG. 10. Instead, when the jar down secondary release mechanism is actuated, the dogs 140 remain in the position shown in FIG. 11 to facilitate release of the running tool R from the hanger assembly H.

Returning now to FIG. 3, with the running tool R removed and the slips 36 set, the detonator assembly 98 is placed into position shown in FIG. 3 by wire line, electric line, or slick line. Thereafter, the line is removed from the wellbore and pressure is increased in the wellbore to set off the detonator assembly 98. Ultimately, during the process of firing the guns as a result of actuation of the detonator assembly 98, pressure builds in chamber 34 from the expanding gas from the perforating guns. This increase in pressure bears on piston 20 shearing pin 22. Since the pressure in chamber 30 is atmospheric and the pressure in chamber 34 is greater than the pressure in chamber 30, piston 20 shifts upwardly reducing the volume of chamber 30. The upward shift of piston 20 places depressed surface 154 opposite keys 14 allowing keys 14 to retract radially inwardly out of depression 16 and back through openings 18 such that there is no longer a connection between housing 156 and mandrel 158 (see FIG. 4). Due to the weight of the gun connected to mandrel 158, the inward radial movement of keys 14 pulls mandrel 12 downhole. Ultimately, shoulders 68 and 58 connect, as shown in FIG. 5. Further downward forces applied to mandrel 12 due to the weight of the gun are transferred from inner sleeve 66 to outer sleeve 52. The downward movement of outer sleeve 52 presents depressed surface 56 to adjacent keys 46 undermining those keys and allowing them to move radially inwardly, as shown in FIG. 5. Once keys 46 have retracted fully into piston 44, piston 44 is no longer trapped by lower cone 42. This allows the weight of the gun acting on inner sleeve 66 through the contact of shoulders 68 and 58 to continue to pull down outer sleeve 52 until shoulder 160 on outer sleeve 52 contacts shoulder 162 on lower cone 42. This can be seen by comparing FIG. 4 to FIG. 5. Thereafter, the weight of the gun pulls downwardly on lower cone 42 allowing the slips 36 slide down ramp surface 104 and into contact with recessed surface 164, as shown in FIG. 6. With lower cone 42 shifted downwardly, spring 90 biases upper cone segments 88 radially inwardly away from slips 36 further undermining slips 36 and releasing the contact between slips 36 and the casing or wellbore. With the slips 36 released and nothing holding up the hanger assembly H, the entire hanger assembly H, the connection G, and the gun drop to the bottom of the wellbore.

Figures 4A, 4B, 4C:
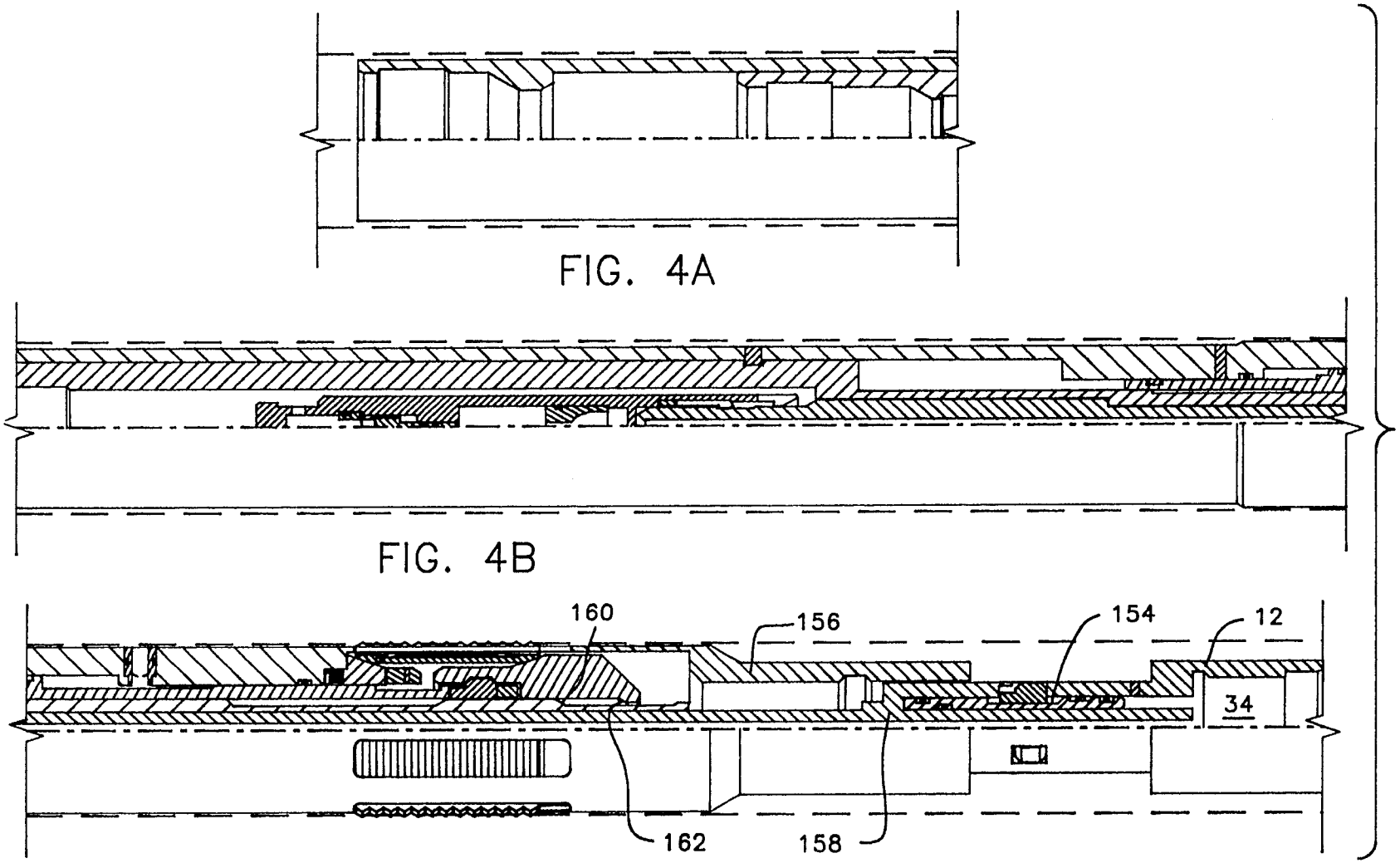
FIGS. 4A–4C are a sectional view of the anchor gun assembly after firing the detonator showing the movement of inner sleeves to release the slips.
Figures 5A, 5B, 5C:
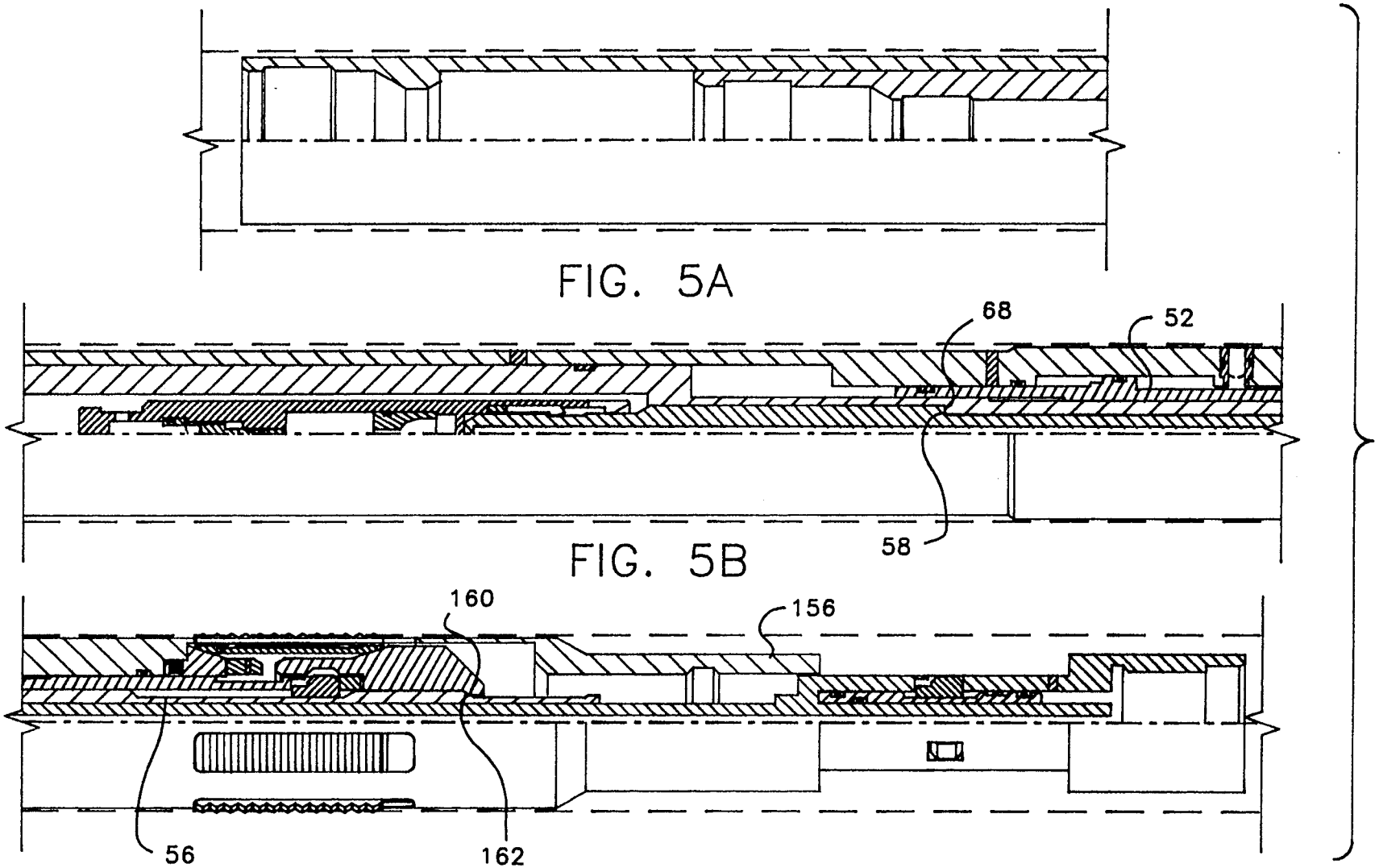
FIGS. 5A–5C are the view shown in FIGS. 4A–4C after further motion to release the slips.
Figures 6A, 6B, 6C:
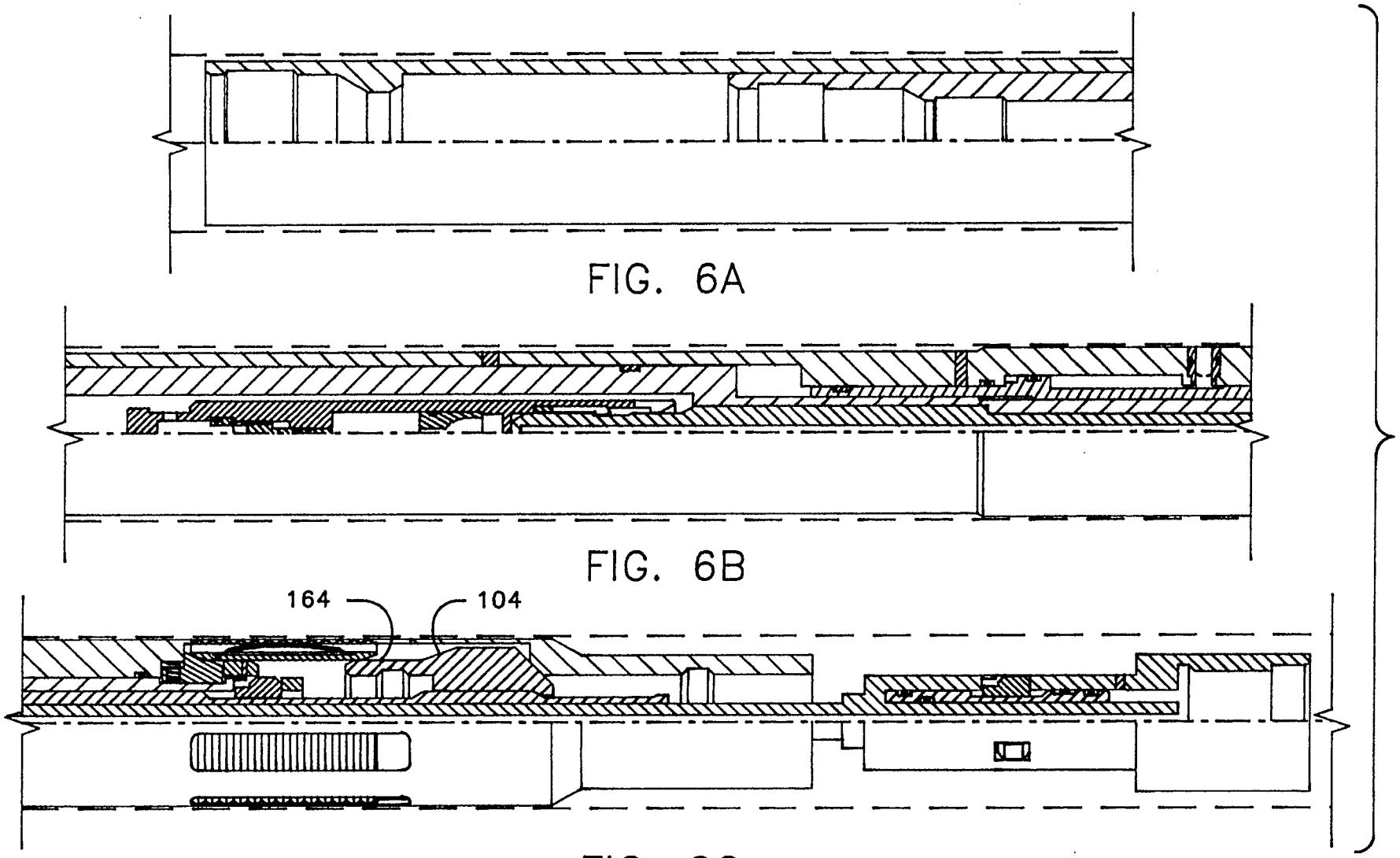
FIGS. 6A–6C are the view shown in FIGS. 5A–5C with the slips completely released, allowing the gun anchor assembly to drop.

In the event the auto-release sequence, illustrated in FIGS. 4–6, does not function, a mechanical release is possible, as shown in FIGS. 7–8. The releasing tool P, shown in FIGS. 7–8, can be any one of a variety of releasing tools such as Otis Model B positioning tool. The releasing tool P is used to drop the hanger assembly with the guns and can be used with or without auto-release feature of the hanger assembly H. An embodiment without the auto-release feature for retrieval after firing is illustrated in FIG. 9.

Referring now to FIG. 7, the releasing tool P is latched on shoulder 166 of outer sleeve 52. If for any reason the gun has failed to go off or the hanger has failed to release, an upward force applied to releasing tool P, shown in FIG. 7, results in breaking of shear screw 60. The outer sleeve 52 moves up to present depressed surface 154 opposite keys 46, as shown in FIG. 7. As previously described, the piston 44 is freed to move upwardly due to the radially inward movement of keys 46. The upward movement of piston 44 presents depressed surface 168 opposite upper cone segments 88 allowing spring 90 to bias upper cone segments 88 inwardly toward depressed surface 168. At that point, the slips 36 are fully disengaged from the casing or wellbore and the weight of the hanger assembly H and the connection G and the perforating gun exerts a force on releasing tool P releasing the releasing tool dogs schematically illustrated as 170 (see FIG. 7). As a result, the releasing tool P can be retrieved while the hanger assembly H with the connection G and the gun dropping to the bottom of the wellbore.

Figures 9A, 9B, 9C:
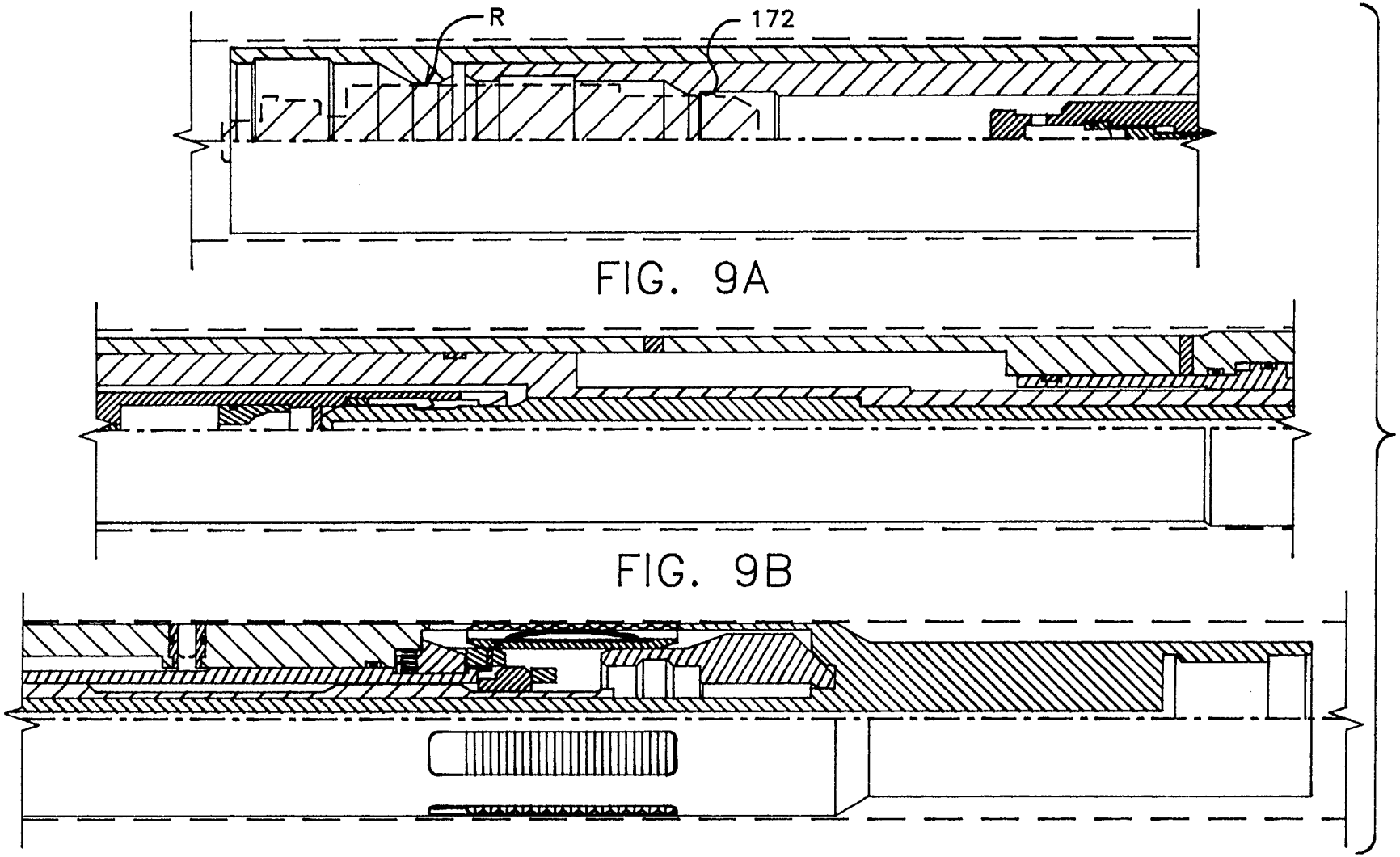
FIGS. 9A–9C are an alternative embodiment of FIGS. 1A–1C showing a retrieving tool inserted to retrieve the gun anchor assembly.

Referring now to FIG. 9. There can be applications where it is desired to retrieve the gun and the hanger assembly H after the gun is fired. By comparing FIG. 1 to FIG. 9, it can be seen that the embodiment shown in FIG. 9 does not have the auto-release feature illustrated in FIG. 1. The hanger assembly H, along with the gun, can be manually retrieved with a running tool, such as Baker Model GS. The running tool R connects to radial surface 172. Thereafter, an upward force applied to the running tool R frees the keys 46 in the manner described above releasing piston 44 to move upwardly and allowing the slips 36 to move down ramp surface 104. Upper cone segments 88 fall into depressed surface 168 and spring 90 biases the upper cone segments radially inwardly allowing the slips 36 to come away from the casing or wellbore. An upward pull applied to the running tool R retrieves the entire assembly.

The apparatus and method of the present invention provide unique advantages to the operator. A gun can be quickly positioned in an unperforated bore using a wire line or electric line. The gun is supported from above and is hydraulically set. Using the running tool illustrated in FIGS. 10 and 11, one smooth buildup of pressure can be used to set the slips 36 and release the running tool R. With the support for the gun being above the gun, if for any reason there is difficulty in removing the gun, less milling is required to get the slips 36 to release, as compared to bottom supported gun assemblies. Because of the method employed, guns of any length may be used without any restriction or limitation to the size of a lubricator mounted above the wellbore. Certain applications involving shallow depths or where there is insufficient weight for setting of slips due to the particular application, are overcome with the apparatus and method of the present invention which can be set hydraulically. The expense and rig space required for coil tubing units and precious rig time for running rigid tubing is reduced with the apparatus and method of the present invention. Instead, the hanger assembly H with the gun can be quickly positioned at the desired depth and the gun set off. In another advantage of the present invention, mechanical means are provided to release the slips if the auto-release feature does not operate properly. With the secondary releasing ability, the slips 36 can be released and the gun dropped to the bottom of the wellbore. Alternatively, the entire assembly can be retrieved for reuse. The running tool disclosed provides additional benefits of hydraulic operation allowing for sequential setting of the slips and release by raising the pressure in the wellbore. The mechanical override feature of the running tool shown in FIGS. 10 and 11 provides backup assurances that disengagement can occur.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for positioning a perforating gun lowered from the surface into a wellbore comprising:

a body;

at least one gripper on said body;

said body having a lower portion and an upper portion, said lower portion supporting the gun;

means for connection of a nonfluid conducting line extending from the surface to said body;

a member on said body movable at least in part in response to pressure applied in the wellbore from the surface;

said gripper selectively actuated for movement responsive to movement of said member, said movement of said gripper affecting the positioning of the gun.

2. The apparatus of claim 1 further comprising:

pressure sensitive valve means mounted to said body to isolate at least in part said member from wellbore pressure until a preselected value is reached.

3. The apparatus of claim 2 wherein:

said member defines a first and second cavities with respect to said body;

said valve means, when actuated to open by applied pressure, allowing fluid communication into said first cavity;

said second cavity is sealingly isolated from said first cavity and is positioned with respect to said first cavity such that pressure in said second cavity exerts an opposed force on said member than pressure in said first cavity;

whereupon pressure increase in said first cavity due to opening of said valve means, an unbalanced force urges movement of the member.

4. The apparatus of claim 3 wherein:

said member is selectively connected to at least one lower cone;

said body further comprises:

at least one upper cone;

said valve means comprises a rupture disc;

whereupon rupture of said disc, said member moves said lower cone into said gripper and said gripper into said upper cone to selectively fixate the body.

5. The apparatus of claim 4 further comprising:

an inner sleeve extending to the lower portion of said body and selectively movable with respect thereto;

an outer sleeve mounted adjacent said inner sleeve and selectively movable in tandem with said inner sleeve;

said outer sleeve selectively movable in tandem with said lower cone;

whereupon firing the gun said inner sleeve moves said outer sleeve which in turn moves said lower cone away from said gripper to drop the gun automatically.

6. The apparatus of claim 5 wherein:

said member is selectively connected to said lower cone whereby relative movement between said outer sleeve and said member releases said connection between said member and said lower cone whereupon a force imbalance on said member shifts it causing release between said upper cone and said gripper;

said outer sleeve, moving in response to applied weight of the gun, initially moving with respect to said lower cone to release said member from said lower cone then moving in tandem with said lower cone to remove support for said gripper by said lower cone.

7. The apparatus of claim 5 further comprising:

a releasing tool adapted to engage said outer sleeve to move it with respect to said member allowing said member to disconnect from said lower cone whereupon movement of said member said upper cone can selectively move away from said gripper releasing said body;

said releasing tool automatically disengaging from said outer sleeve upon release of said body.

8. The apparatus of claim 5 further comprising:

a releasing tool adapted to engage said outer sleeve to move it with respect to said member allowing said member to disconnect from said lower cone whereupon movement of said member said upper cone can selectively move away from said gripper;

said releasing tool retaining said outer sleeve to facilitate removal of said body from the wellbore.

9. The apparatus of claim 1 wherein said means for connection further comprises:

a running tool mounted to said body at one end;

said running tool responsive to pressure buildup in the wellbore to selectively disengage from said body after a lower pressure has acted on said member to actuate said gripper.

10. The apparatus of claim 9 wherein:

said running tool is formed having a housing;

at least one collet operably connected to said running tool housing;

a mechanical override mechanism on said running tool responsive to an applied force to create a relative movement between said running tool housing and said collet to release said running tool housing from said body supporting the gun in event pressure buildup fails to effectuate said disengagement.

11. The apparatus of claim 9 wherein:

said running tool further comprises:

a housing;

a piston on said housing;

at least one collet on said housing;

valve means actuable into an open position on a preset differential pressure;

whereupon application of a pressure in the wellbore higher than the pressure to initiate movement of said member to set said gripper, said valve means opens allowing wellbore pressure to act on said piston causing relative movement between said collet and said housing allowing disengagement between said running tool and said body.

12. The apparatus of claim 11 wherein said running tool further comprises:

a mechanical override mechanism selectively actuable on said piston to cause relative movement between said collet and said housing for release of said housing from said body in the event said valve means fails to actuate by pressure buildup.

13. The apparatus of claim 6 wherein said means for connection further comprises:

a running tool mounted to said body at one end;

said running tool responsive to pressure buildup in the wellbore to selectively disengage from said body after a lower pressure has acted on said member to actuate said gripper.

14. The apparatus of claim 13 wherein:

said running tool is formed having a housing;

at least one collet operably connected to said running tool housing;

a mechanical override mechanism on said running tool responsive to an applied force to create a relative movement between said running tool housing and said collet to release said running tool housing from said body supporting the gun in event pressure buildup fails to effectuate said disengagement.

15. The apparatus of claim 13 wherein:

said running tool further comprises:

a housing;

a piston on said housing;

at least one collet on said housing;

valve means actuable into an open position on a preset differential pressure;

whereupon application of a pressure in the wellbore higher than the pressure to initiate movement of said member to set said gripper, said valve means opens allowing wellbore pressure to act on said piston causing relative movement between said collet and said housing allowing disengagement between said running tool and said body.

16. The apparatus of claim 15 wherein said running tool further comprises:

a mechanical override mechanism selectively actuable on said piston to cause relative movement between said collet and said housing for release of said housing from said body in the event said valve means fails to actuate by pressure buildup.

17. A method of positioning a perforating gun in a wellbore from the surface comprising the steps of:

lowering a gun with a positioning tool on a nonfluid conducting line to a desired position;

pressurizing the wellbore from the surface;

setting at least one slip on the positioning tool due to said pressurizing.

18. The method of claim 17 further comprising:

running in a running tool with said gun and said positioning tool;

building pressure in the wellbore beyond the point of setting said slip;

automatically releasing said line supported running tool from said positioning tool due to said building pressure step;

retrieving the running tool with said line.

19. The method of claim 17 further comprising:

shifting a piston selectively connected to a first cone due to said pressurizing;

ramping said slip out on said first cone and into a second cone;

ramping said slip out on said second cone.

20. The method of claim 19 further comprising the steps of:

firing the gun;

releasing the piston from said first cone using the weight of the gun;

shifting said piston due to a force imbalance;

undermining support of said slip by said first and second cones by said shifting;

allowing the gun and positioning tool to drop.

21. The method of claim 20 further comprising the steps of:

initiating piston movement by breaking a rupture disc;

building up pressure in a first chamber adjacent said piston due to said breaking;

creating an unbalanced force on said piston due to pressure difference between said first chamber and a second chamber positioned adjacent said piston and initially at atmospheric pressure.

22. The method of claim 21 further comprising the step of:

using gun weight to release said piston from said first cone and to push said first cone away from said slip to facilitate release of the positioning tool.

23. The method of claim 22 further comprising the steps of:

providing a secondary release for said slip further comprising the steps of:

shifting a sleeve with a running tool;

releasing the connection between said piston and said first cone by shifting said sleeve;

releasing the positioning tool from the running tool as a result of releasing said slip.

24. The method of claim 22 further comprising:

running in a running tool with said gun and said positioning tool;

building pressure in the wellbore beyond the point of setting said slip;

automatically releasing said line supported running tool from said positioning tool due to said building pressure step;

retrieving the running tool with said line.

25. The method of claim 18 further comprising the steps of:

providing a secondary release feature for said running tool further comprising the steps of:

applying mechanical force on a body;

holding at least one collet from moving;

creating relative movement between the said body and collet;

releasing said positioning tool from said running tool.

* * * * *